US006955354B1

(12) United States Patent
Andjelic

(10) Patent No.: US 6,955,354 B1
(45) Date of Patent: Oct. 18, 2005

(54) CHESS GAME

(76) Inventor: Steven Andjelic, 195 Marygrove Crescent, Winnipeg, Manitoba (CA) R3Y 1M4

( * ) Notice: Subject to any disclaimer, the term of this patent is extended or adjusted under 35 U.S.C. 154(b) by 0 days.

(21) Appl. No.: 10/838,941

(22) Filed: May 3, 2004

(51) Int. Cl.[7] ..... A63F 3/00
(52) U.S. Cl. ..... 273/260; 273/261
(58) Field of Search ..... 273/260, 261

(56) References Cited

U.S. PATENT DOCUMENTS

| | | | |
|---|---|---|---|
| 5,275,414 | A | 1/1994 | Stephens et al. |
| 5,449,178 | A | 9/1995 | Castronova |
| 5,582,410 | A | 12/1996 | Hunt |
| 5,957,455 | A | 9/1999 | Aldridge |
| 6,142,474 | A | 11/2000 | Tachkov et al. |

OTHER PUBLICATIONS

Arnhem Chess (4 pages).*
Reserve Chess (1 page).*
Modest proposal capture rules (8 pages).*
Bughouse and Tendem Chess (5 pages).*
The chess variant pages (7 pages).*

* cited by examiner

*Primary Examiner*—Vishu K. Mendiratta
(74) *Attorney, Agent, or Firm*—Nikolai & Mersereau, P.A.

(57) ABSTRACT

A variation of the game of chess featuring reserve pieces used to replace captured pieces. Reserve pieces are gained by capturing the opponents remaining pieces on the board at checkmate. In one embodiment the replacement pieces are placed on the square they originated on at the beginning of the game or the next available open square in the file. In another embodiment the pieces are replaced on the square they were captured at thus retaking the square and the opponents piece. Replacing the captured piece may be optional or mandatory and may occur at the turn of the capture or later. The game can be played by two or more players in person or at distant locations. A scoring system can be used for tournaments. Computers can be used to keep track of the reserves, scoring, matching of players in the tournament and communications for remote players over the internet.

43 Claims, No Drawings

CHESS GAME

BACKGROUND OF THE INVENTION

1. Field of the Invention

This invention relates to the game of chess and more particularly to a variant where an opponents uncaptured pieces at the end of the game are added the victor's army as reserves to be used as replacements in the next game in a series.

2. Description of the Related Art

There are many variations on the game of chess. In one variation several boards are used on different levels to play three-dimensional chess. In another variation a larger board is used having a larger matrix of squares and more than two sets of players for providing more than two players to play at once. In some games teams are used with a full complement of pieces arrayed in the standard formation. In other team games the pieces less than the regular full compliment of pieces are used and they are arrayed in non-conventional manner. In other variations the board has a field which is not square and the number of spaces on the board is greater then a standard 64 spaces. In other games captured pieces are replaced by pawns and there are various rules of play for capturing pieces. In another variation the pieces have concealed ranks and the player has to remember which piece is which. Each of the variations of chess present challenging new strategies of play.

SUMMARY OF THE INVENTION

The game is a variation of the game of chess, which encourages a player to obtain checkmate while minimizing the capturing of the opponent's pieces. The player is rewarded in checkmating the opponent by receiving as reserves for future games the pieces remaining on the board at the end of each game and in a second embodiment by also capturing the opponents reserves as well as the pieces remaining on the board at the end of each game.

The dynamics of the game change and the strategies employed change due to the use of reserves and the need to capture the maximum number of reserves or to reduce the number of reserves available for your opponent to capture. The reserves available may be secret in one version of the game and openly shown in another version of the game. The replacement pieces may be added during the next turn or thereafter by placement of the reserve piece in its original board position or if that position is taken in the first available open space in its file. Alternatively the replacement piece can be placed on the square it was taken from to recapture the square and remove the opponents capturing piece. The replacement piece may be a like kind piece as that taken or the piece from the file of the original piece.

The turn of a player may be the replacement of the piece or the replacement of a piece plus a move of a piece.

Computers may be used to keep track of the reserves of each player, to score the game in a tournament, to match players in the tournament, and to link players at remote sites.

Scoring may be by the number of reserves in possession or by a point system for each reserve piece, by the number of pieces captured or some combination of games played and reserves in possession and pieces taken off the board by capture in a conventional manner.

The games may be timed, or each move may be timed. Tournaments may last for a specified number of hours or until a specified number of games have been played or be open ended.

OBJECTS OF THE INVENTION

It is an object of the invention to create a variation on the game of chess wherein a bank of captured pieces from previous games is created for use in future games in a tournament.

It is an object of the invention to change the strategy of play in a game of chess to obtain a checkmate with the minimum number of the opponent's pieces captured during the game.

It is an object of the invention to bank as many pieces as possible in order to obtain points for winning a tournament.

It is an object of the invention to bank as many pieces as possible in order to maximize the reserve pieces available for play in the chess tournament.

It is an object of the invention to use computers to track the bank of reserve pieces.

It is an object of the invention to use computers to play the modified chess game over the internet.

It is an object of the invention to use video game consoles, computers, or other devices to score and rank the players in a tournament based on the bank of pieces and number of games played.

Other objects, advantages and novel features of the present invention will become apparent from the following description of the preferred embodiments.

DESCRIPTION OF THE PREFERRED EMBODIMENTS

The modified game of chess will simulate armies wherein the victor captures the pieces remaining "alive" on the board at the time of checkmate, with the exception of the king, to use as reserve pieces in the next battle in the war, i.e. against the next game in a tournament.

There are optional rules for the game. In one style of play the victor only captures the opponents pieces remaining on the board at the end of the game, except for the king. In a variant the victor obtains the opponents pieces remaining on the board at the end of the game, except for the king, plus the opponent's reserve pieces.

During the game when a piece is captured the player losing the piece may replace it by taking a piece from the reserve pieces and placing it on the board. There can be several variations of the game with different rules for which pieces are replaced and where to place them on the board. In one variation if, for example, the King's pawn is captured it can only be replaced if there is a King's pawn in the reserve pieces. In another variation if the King's pawn is captured it can be replaced by any pawn. Similarly with the King's or Queen's Bishop, Knight or Rook they may be separately tracked or replaced with any Bishop, Knight or Rook in the bank of reserve pieces.

The replacement of pieces on the board rules can have several variations. In one embodiment the piece taken, lets say the King's Rook, can be replaced by setting another King's Rook from the reserve pieces on the King's Rook square as if it were just starting a new game. If the square is occupied then the King's Rook can be placed in the next available space in the Rook's file. Other variations of where to put the Rook can be used. For example the piece capturing the Rook may be taken if there is a replacement Rook which, would then occupy the space where the Rook was taken. The opponent therefore has the risk of losing his attacking piece to the replacement piece on that square. The original attacker can then pull up a reserve piece to replace his lost attacking piece as the battle for the square continues until one player optionally decides not to use up reserves fighting for the square or there are no more reserve pieces to choose from.

The turn of the play can vary in that the replacement of the piece counts as a turn or the replacement of the piece plus a regular move including movement of the replaced piece or another piece counts as a turn.

In one version of the game it is optional for the player to call up a reserve piece thereby depleting his reserve pieces. In a variation of the game it may be mandatory to replace a lost piece thus tending to keep the reserve forces low in the tournament as more pieces are used up from the reserves balanced against the number of pieces captured at the end of the game.

Another game variation is that the captured piece may be replaced immediately from the reserves or at any later turn.

The reserve pieces each player has may be open for viewing so the relative strength of the players reserves are visible to both players or alternatively under another set of rules the bank of reserve pieces may be secret from the opponent.

To begin a tournament the players have a standard chess board set up and play commences in the normal manner. The strategy of the players is to checkmate the opponent while taking the fewest number of the opponents pieces which will then be added to his bank of reserve pieces at the end of the game. If a player is losing he may want to sacrifice his high valued pieces such as the queen before a checkmate in order to lower the value of the pieces remaining on the board at the end of the game, which would then be added to the opponents bank of reserve pieces.

A computer can be used to record the moves of the game and which pieces have been added to the reserve pieces for each game and for a running total of which pieces have been added to the reserve pieces, which pieces have been called up out of the reserves and the remaining pieces in the bank of reserve pieces. Optionally a large number of pieces each individually labeled as to their starting position may be used.

Chess tournaments can be played with the aid of the computer keeping track of the reserve pieces and ranking the players in the tournament. The computer can then rank the players and select the next opponents for each player based on their current rankings. The rankings may be by the accumulated reserves to match players with even reserves or by the number of victories, by the number of reserve pieces defeated or by some other formula.

Alternatively players may challenge other players rather than have the computer select which players are to be matched.

Scoring of the tournament can be by number of reserve pieces taken, number of reserves in possession combined with the number of games played or some other formula. For example the captured reserve pieces may have points awarded, a Queen may be worth 4 points, a Rook 3 points, a Bishop or a Knight 2 points and a Pawn 1 point. The total points of the pieces in reserve would be added up to provide a point total for each player and the players ranked accordingly. Different ranks may be awarded depending on the scores. For example, a promotion to sergeant may occur at 100 points and you make general at 1,000 points.

The chess tournaments can be played either in person, over the internet, by networked game console or by some other communication system such as by mail.

The chess games can have time limits, either as tournament rules or limits agreed to by the players. For example a standard chess game clock can be used and each player limited in the time he is allowed to use during the game. The time limits can also be on each move made during the game.

A tournament can end when one player eliminates all the other players, when one player reaches a specified point total, at a time limit or after a specified number of games.

The chess tournament may be continuous with players vying for the highest number of points achieved.

If the chess game is a draw or a stalemate then either both the players may add to their reserves or alternatively neither player may add to their reserves. In timed games the player ahead at the end of the time limit is the victor.

The chess game can be played with one person against another person or against a computer as the opponent.

Obviously, many modifications and variations of the present invention are possible in light of the above teachings. It is therefore to be understood that, within the scope of the appended claims, the invention may be practiced otherwise than as specifically described.

What is claimed is:

1. A method for playing a modified game of chess comprising:

a) establishing a bank of pieces for each player, each said bank including the full complement of pieces required for the player to play a traditional game of chess and any pieces captured by the player in at least one earlier chess game, said pieces captured including the pieces of the player's opponent remaining on the chess board in said earlier at least one chess game at the time the player checkmated the opponent in said at least one chess game, with the exception that the king, b) setting up the chess board for a chess game using said full complement of pieces required for the players to play a traditional game of chess, c) playing said game of chess by conventional rules plus replacement rules that allow each player to use pieces remaining in said player's bank as replacements for pieces captured by the other player during said game.

2. A method for playing a modified game of chess as in claim 1 including the step of:

adding the bank of the defeated player to the victor's reserves at the end of a game, repeating steps b) and c).

3. A method for playing a modified game of chess as in claim 1 including the step of:

replacing a piece taken at its original position unless that square is taken in which case the next available square in that file is used.

4. A method for playing a modified game of chess as in claim 1 including the step of:

replacing a piece taken at the position it was taken from.

5. A method for playing a modified game of chess as in claim 1 including the step of:

replacing the piece captured with any like kind piece.

6. A method for playing a modified game of chess as in claim 1 including the step of:

replacing the piece captured a like kind piece from the file of the piece captured.

7. A method for playing a modified game of chess as in claim 1 including the step of:

replacing the piece captured on the next move after it was captured.

8. A method for playing a modified game of chess as in claim 1 including the step of:

replacing the piece captured on any move after it was captured.

9. A method for playing a modified game of chess as in claim 1 including the step of:

replacing a piece captured is mandatory if possible.

10. A method for playing a modified game of chess as in claim 1 including the step of:
replacing a piece captured is optional.

11. A method for playing a modified game of chess as in claim 1 including the step of:
replacing a piece captured ends the turn of the player.

12. A method for playing a modified game of chess as in claim 1 including the step of:
replacing a piece captured plus moving a piece ends the turn of the player.

13. A method for playing a modified game of chess as in claim 1 including the step of:
a computer tracks the reserves of each player.

14. A method for playing a modified game of chess as in claim 1 including the step of:
each piece is labeled for origin to aid in tracking the reserves for each player.

15. A method for playing a modified game of chess as in claim 1 including the step of:
displaying the reserves of each player for the opponent to see.

16. A method for playing a modified game of chess as in claim 1 including the step of:
keeping the reserves of each player secret from the opponent.

17. A method for playing a modified game of chess as in claim 1 including the step of:
scoring the players by the reserves he has.

18. A method for playing a modified game of chess as in claim 17 including the step of:
playing a tournament which ends when a specified score is reached.

19. A method for playing a modified game of chess as in claim 1 including the step of:
matching opponents by challenges between the players.

20. A method for playing a modified game of chess as in claim 1 including the step of:
matching opponents by the reserves they have.

21. A method for playing a modified game of chess as in claim 1 including the step of:
playing the game on a computer.

22. A method for playing a modified game of chess as in claim 1 including the step of:
playing the game in person.

23. A method for playing a modified game of chess as in claim 1 including the step of:
playing the game by computer over the internet.

24. A method for playing a modified game of chess as in claim 1 including the step of:
playing the game by video console over a network.

25. A method for playing a modified game of chess as in claim 1 including the step of:
having a time limit for each move of the game.

26. A method for playing a modified game of chess as in claim 1 including the step of:
having a time limit for each game.

27. A method for playing a modified game of chess as in claim 1 including the step of:
having a time limit for each tournament.

28. A method for playing a modified game of chess as in claim 1 including the step of:
playing a tournament which ends when a specified number of games have been played.

29. A method for playing a modified game of chess as in claim 1 including the step of:
playing a tournament which ends when a specified time limit is reached.

30. A method for playing a modified game of conventional chess comprising,
a) setting up a chess board for a conventional game of chess,
b) playing a chess game by conventional rules, to checkmate the opponent,
c) capturing the opponents pieces remaining on the board at checkmate except the king to add to the victor's reserves,
d) setting up a chess board for an additional game with conventional pieces plus any reserve pieces from previous games to play the next opponent, with his conventional pieces, plus any reserve pieces he has, and replacing lost pieces during the game with reserve pieces, placed on the board by replacement rules,
e) playing a chess by conventional rules, plus the replacement rules, to checkmate the opponent, and cumulatively adding the loser's remaining pieces to the victor's reserves,
f) repeating steps (d) and (e) until the end of a series of games.

31. A method for playing a modified game of conventional chess as in claim 30 with the further step of:
playing the same opponent again in steps (e) and (f) with his accumulated reserves if any.

32. A method for playing a modified game of conventional chess as in claim 30 with the further step of:
playing a different opponent in steps (e) and (f) with his accumulated reserves if any.

33. A method for playing a modified game of conventional chess as in claim 30 with the further step of:
the opponent on losing does not cumulatively gain any reserves.

34. A method for playing a modified game of conventional chess as in claim 30 with the further step of:
in tournament play the winner obtains the opponents reserves.

35. A method for playing a modified game of conventional chess as in claim 30 with the further step of:
replacing a captured piece with a like kind piece by placing it on the originating square for that piece.

36. A method for playing a modified game of conventional chess as in claim 30 with the further step of:
replacing a captured piece with a like kind piece by placing it on the square it was taken from.

37. A method for playing a modified game of conventional chess as in claim 30 with the further step of:
winning a tournament by defeating the all the opponents by elimination of losers in each round.

38. A method for playing a modified game of conventional chess as in claim 30 with the further step of:
winning a tournament by winning a specified number of games.

39. A method for playing a modified game of conventional chess as in claim 30 with the further step of:
winning a tournament by playing a specified number of games and having the largest number of points or reserve forces.

40. A method for playing a modified game of conventional chess as in claim 30 with the further step of:
using a computer to keep track of the number of reserves of each player.

41. A method for playing a modified game of conventional chess as in claim 40 with the further step of:
using a computer to keep track of the games played in a tournament.

42. A method for playing a modified game of conventional chess as in claim 30 with the further step of:

using a computer to keep track of the games played in a tournament.

43. A method for playing a modified game of conventional chess as in claim 40 with the further step of:

using an internet connection to play opponents remotely.

* * * * *